United States Patent [19]

Skorka et al.

[11] Patent Number: 4,826,048

[45] Date of Patent: May 2, 1989

[54] DISPENSER FOR MANUALLY DISCHARGING PLURAL MEDIA

[75] Inventors: Thomas Skorka, Radolfzell; Hans-Josef Schuetz, Donaueschingen, both of Fed. Rep. of Germany

[73] Assignee: Ing. Erich Pfeiffer GmbH & Co. KG, Fed. Rep. of Germany

[21] Appl. No.: 114,686

[22] Filed: Oct. 29, 1987

[51] Int. Cl.[4] ..... B67D 5/52

[52] U.S. Cl. ..... 222/137; 222/321; 222/145; 239/304; 239/306

[58] Field of Search ..... 222/145, 134–137, 222/321, 143; 239/304, 306, 303, 333, 414

[56] References Cited

U.S. PATENT DOCUMENTS

| | | | |
|---|---|---|---|
| 2,892,317 | 6/1959 | Holmes | 239/303 |
| 2,941,696 | 6/1960 | Homm | 222/136 |
| 2,973,883 | 3/1961 | Modderno | 222/136 |
| 3,084,871 | 4/1963 | Puglis | 239/303 |
| 3,236,457 | 2/1966 | Kennedy et al. | 239/304 |
| 3,416,709 | 12/1968 | Shultz et al. | 239/306 |
| 3,575,319 | 4/1971 | Safianoff | 222/135 |
| 3,718,234 | 2/1973 | Bagguley | 222/135 |
| 3,760,986 | 9/1973 | Castner et al. | 222/137 |
| 3,990,611 | 11/1976 | Sojka | 222/135 |
| 4,532,967 | 8/1985 | Graf | 222/321 |

FOREIGN PATENT DOCUMENTS

| | | | |
|---|---|---|---|
| 3005008 | 10/1981 | Fed. Rep. of Germany . | |
| 8500025 | 4/1985 | Fed. Rep. of Germany . | |
| 1116039 | 6/1968 | United Kingdom | 222/145 |

*Primary Examiner*—H. Grant Skaggs

*Attorney, Agent, or Firm*—Steele, Gould & Fried

[57] ABSTRACT

A dispenser (1) has two facing and outwardly sealed reservoirs (2) for separate media components, as well as for each reservoir (2) a separate discharge pump (3), both discharge pumps (3) being simultaneously operable by means of a common handle (10). Thus, the components are separately sucked in and are kept separate up to a mixing zone located inside or outside the handle (10), but with respect to the use thereof are brought together at the latest possible time. The components can be brought together in a precisely dosed quantity ratio.

35 Claims, 1 Drawing Sheet

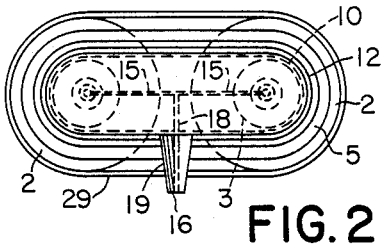
FIG. 2
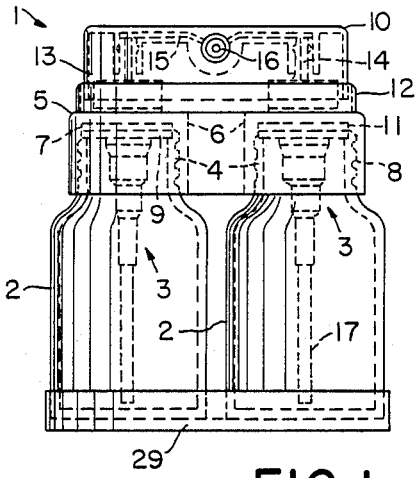
FIG. 1
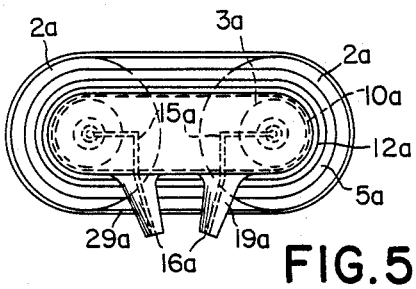
FIG. 5
FIG. 3
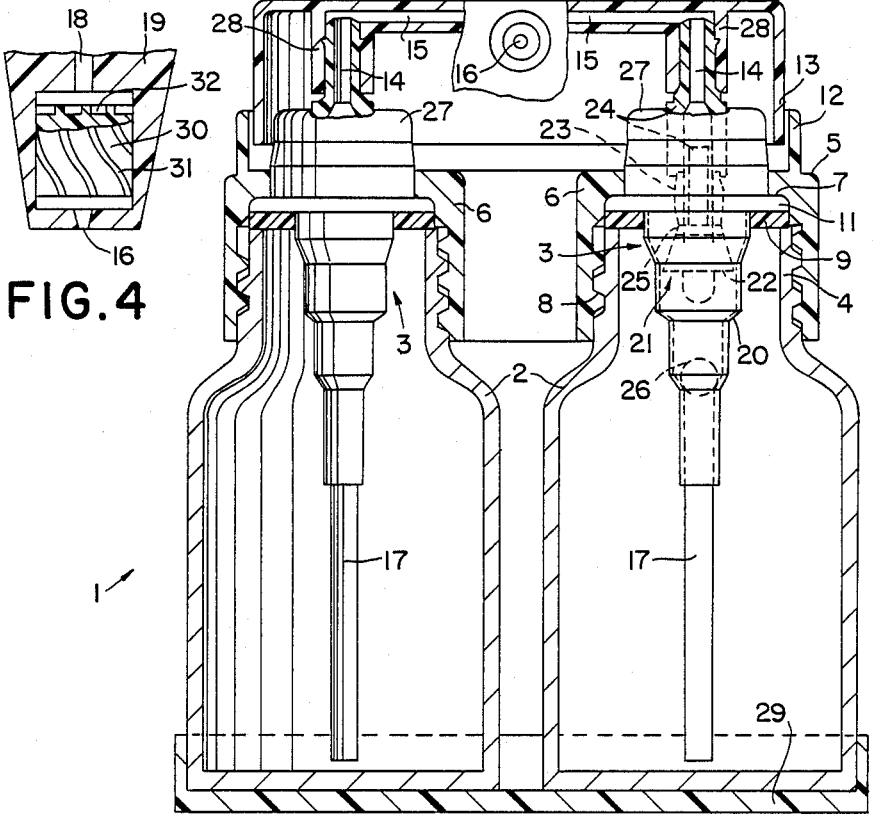
FIG. 4

DISPENSER FOR MANUALLY DISCHARGING PLURAL MEDIA

The invention relates to a dispenser for media, with a reservoir, with which is associated a manually operable discharge means, which may be provided on a discharge or pump casing to be arranged on the reservoir with an inlet connecting the latter to an outlet port.

In particular pharmaceutical and cosmetic media, but also technical and similar media, can in the use state comprise two or more components, which must be mixed together just prior or during use in order to maintain a reaction time, provide a particularly fresh and therefore effective product or because in the mixed state they tend towards changes, e.g. a shorter life. Therefore as a rule such mixed media are held available separately from one another in separate containers. Either the components have to be mixed prior to use, or in the case of pharmaceutical and cosmetic products they are occasionally applied in direct succession and thereby made to combine or mix. However, this requires a certain skill and also very considerable care, if it is a question of using the components in a precise mixing ratio with one another.

The problem of the invention is to provide a dispenser of the aforementioned type enabling at least two components to be used in conjunction with one another to be applied in precisely time-matched manner an by simple manual actuation are brought together.

According to the invention this problem is solved in the case of a dispenser of the aforementioned type in that for at least two media components separate reservoirs are provided with separate discharge means and at least two discharge means can be jointly operated with a common handle. Thus, on the one hand the components in their not yet used, stored quantities are constantly kept separate and on the other hand the two components can be brought together and discharged in a relatively precisely determinable quantity ratio by operating a single handle. Discharge means of the aforementioned type can be constructed as relatively accurately dosing dosing pumps, which deliver a precisely reproducible medium quantity for each pump stroke and, as a function of the requirements, the jointly operated discharge pumps can have the same or different deliveries.

It is conceivable to provide the arrangement in such a way that the discharge pumps deliver in the manner of a register control directly following one another, i.e. successively deliver in stages, so that the associated components are successively discharged. However, it is particularly advantageous if the construction is such that on operating the handle at least two discharge pumps operable by the latter simultaneously deliver, so that the components are mixed together directly at the time of discharge. For this purpose, the outlet channels of at least two discharge pumps appropriately lead to a component mixing zone, which is preferably in the immediate vicinity of at least one outlet port.

If at least one component is of a nature such that its direct contact with air prior to mixing with the other components is prejudicial, then the mixing zone is advantageously provided in the discharge direction upstream of the outlet port and in particular immediately adjacent to the entry into an outlet nozzle, preferably both outlet channels passing into a common end channel, which in turn issues into the outlet nozzle, which is e.g. provided on the circumference and/or in the vicinity of its rear end face with helical or spiral groove-like swirl channels. Thus roughly as from the region in which the components are brought together and upstream of the outlet ports are formed vortex zones or chambers, in which the components brought together are intensely mixed, whilst making use of the discharge pressure.

Not only in the case of a successive discharge of the components, but also with simultaneous discharge thereof, it can be advantageous as a result of the specific characteristics of these components, if they are only brought together outside the discharge apparatus, so that there is no possibility of mixed components being left behind in the discharge apparatus. In this case the mixing zone is downstream of the outlet port in the discharge direction and in particular outside the discharge apparatus in the open. As a function of the characteristics of the medium, it can be appropriate for separate application of the discharged components at adjacent points, where they are e.g. mixed together by rubbing. However, in this case, the components can also be very well mixed prior to reaching the application point outside the discharge apparatus, because manually operable pumps when using correspondingly designed discharge nozzles are particularly suitable for producing ultra-fine spray jets. If the outlet ports are directed towards one another in such a way that the jets passing out of them overlap not too far from the outlet or discharge nozzles, particularly when producing spray jets, due to the very fine droplet distribution of the medium in said spray zone formed by the overlap, it is possible to obtain a very intense thorough mixing at an extremely short time prior to the meeting with the application point. This can be very advantageous, particularly in the case of pharmaceutical products, because these frequently have an activity which is better the fresher they are mixed prior to use.

In order to obtain a very compact and easily handleable construction, the discharge opening or openings are located immediately at the handle, being located flush in a wall of the handle or at the end of a projection, such as a spout, projecting over the outer circumference of the handle.

In particular, if constructionally separate reservoirs are used, which are only spatially associated through the discharge apparatus, it is advantageous if in order to obtain an optimum stability of the overall apparatus, the handle interconnects at least two juxtaposed discharge pumps, particularly in the manner of a bridge and is preferably constructed in one piece. This is further improved if the handle is located in the vicinity of a common bridge-like top cap for the in particular bottle-like reservoir and preferably engages with a wall or partition edge in a ringweb of the top cap corresponding to the basic shape thereof, so that the two separate, bottle-like and optionally identical reservoirs do not have to be in direct contact or mechanically firmly connected with one another and can instead be positioned in adjacent staggered manner with a limited spacing.

According to a further development of the invention, the top cap has separate mounts for the discharge pumps, as well as optionally separate connecting caps for bottle necks of the approximately parallel and immediately adjacent reservoirs. The top cap can also be constructed in one piece. The bottle necks can be engaged with the connecting caps by simple, pressuretight snap connections, either separately or jointly, which is particularly advantageous if the two reservoirs are formed by a single, dimensionally stable, e.g. one-piece component. In the case of a separate construction of the reservoirs, the bottle neck can also be engaged with the connecting caps by means of threads, because the reservoirs can be screwed independently of one another into the connecting caps.

To further increase the strength of the overall apparatus and for avoiding loading of the connection of the discharge apparatus to the reservoirs which may lead to leaks, following the production of this connection an additional mounting bridge can be fitted to the reservoirs and is preferably formed by a flat plug cap closely embracing the bottom area of the reservoirs.

The inventive construction is particularly suitable for those discharge apparatuses, in which the discharge pumps are constructed as thrust piston pumps and not as bellows, elastic chambers or similar pumps, because such thrust piston pumps have important advantages. They can be operated at higher discharge pressures, are suitable for very accurate dosing, permit an air-tight seal of both the pump casing and also the reservoir when the pump is in the initial position, ensure a high discharge speed and are suitable both for dropwise and spray jet-like discharge. They can also be used for liquid and pasty or semifluid and similar flowable media. The discharge pump appropriately has an outlet valve controlled by the pressure in the pump chamber or as a function of the pump piston position. This valve consequently only opens the connection from the pump chamber to the outlet channel when a relatively high pressure has built up in the pump chamber in the closed state of a suction valve producing the connection to the reservoir.

These and other features of preferred embodiments of the invention can be gathered from the description and drawings and the individual features can be realised in any embodiment of the invention and in other fields, either singly or in the form of subcombinations.

The invention is described hereinafter relative to embodiments and the attached drawings, wherein show:

FIG. 1 an inventive dispenser in elevation.

FIG. 2 the dispenser of FIG. 1 in plan view.

FIG. 3 the discharge apparatus of FIG. 1 on a larger scale and in a part axially sectioned representation.

FIG. 4 a detail of FIG. 2 on a larger scale and in sectional form.

FIG. 5 another embodiment of a dispenser in a representation corresponding to FIG. 2.

As shown in FIGS. 1 to 4, an inventive dispenser 1 has two bottle-like, substantially cylindrical reservoirs 2 for storing media components, in each of which a discharge pump 3 is inserted in the vicinity of the bottle neck 4. The two bottle necks 4 are positively interconneced by means of a top cap 5 which is oval in plan view, that the two reservoirs 2 are positioned parallel to one another with a limited spacing and at the same height. In the vicinity of each roughly semicircular end, the top cap 5 forms on the inside a substantially axially symmetrical connecting cap 6, which in the vicinity of the semicircular end forms a common partition with the said top cap 5 and has the same height as the latter. The connecting caps 6 engage over the two bottle necks 4 and are fixed by means of screw thread connections 8 onto said necks 4. Each connecting cap 6 forms a mount 7 for the associated discharge pump 3 in the form of a ring shoulder receiving a ring flange of the pump casing, said shoulder tensioning the ring flange 11, accompanied by the interposing of a circumferential joint 9, against the outer end face of the associated bottle neck 4.

The two discharge pumps 3 are connected with a common handle 10 in the form of an actuating cap displaceable axially parallel to the discharge pumps 3 and which essentially has the same basic shape as the top cap 5, but in plan view is slightly smaller than the latter. Handle 10 engages with its oval wall or partition border 13 facing reservoirs 2 in the inside of a ring web 12 surrounding it with a limited spacing and which projects over the outer end face of the end wall of the connecting cap 5 forming the end partitions of connecting caps 6. In the circumferential wall of handle 10 forming the partition border 13, an outlet port 16 is provided adjacent to its end wall to be pressed for operation and said port is connected to the two pump chambers of both discharge pumps 3 via outlet channels 14 of the two pumps 3 and outlet channels 15 connected thereto in handle 10. The two discharge pumps 3 are in turn in each case connected by a suction channel 17 formed by a riser tube to the associated reservoir 2 on the suction side and in the vicinity of the bottom. By pressing down handle 10 counter to the tension of return springs of the two discharge pumps 3, medium is simultaneously delivered from both reservoirs 2 in the direction of the outlet port 16 and prior to reaching the latter is mixed with the other component optionally by bringing together in turbulent form, the thus prepared mixed medium then passing out as a single, optionally sprayed jet from the outlet port 16. It is also conceivable to discharge the two components by means of separate nozzle openings arranged immediately adjacent to one another, e.g. in concentric rings and thereby bringing said components together in the vicinity of the outlet The nozzle openings can then be provided in a common nozzle body. In the represented embodiment, the two equiaxial outlet channels 15 are directed against one another up to the connection point to an end channel 18, or are formed by a single through channel, to which is connected at right angles the end channel 18 leading to outlet port 16. In the vicinity of said connection, the arrangement of a cross-sectionally optionally widened vortex chamber is conceivable. The two outlet channels 15 are appropriately of the same length, so that both components are exposed to roughly the same flow conditions. The outlet port 16 provided at the end of the freely projecting spout 19 according to FIG. 2 is located in the middle of a long side of handle 10.

Each discharge pump 3 is constructed as a thrust piston pump, whose cylinder casing 20 projecting through the bottle neck 4 into the associated reservoir 2 and which is reduced several times in external diameter with respect to suction channel 17 is located over its entire length in spaced manner from the inner circumference of bottle neck 4. Discharge pump 3 has a piston unit 21 displaceable in cylinder casing 20 and provided with an elastic piston sleeve 22, which is constructed at its outer end in one piece with an elastically resilient compression sleeve 23. Piston sleeve 22 and compression sleeve 23 are arranged on the outer cirucmference of a piston rod 24, which projects from the pump casing and over ring web 12 into handle 10 and is traversed by the outlet channel 14. In the transition region to the compression sleeve 23, piston sleeve 22 forms the outer, annular valve closure part of a not shown outlet valve 25, whose valve seat is provided on piston rod 24. Piston sleeve 22, including the valve closure part, accompanied by the recovery compression of the compression sleeve 23, can be moved with respect to the piston rod 24 counter to the direction of the pump stroke, so that outlet valve 25 opens. This movement can take place either towards the end of the pump stroke by the piston sleeve 22 striking against an inner shoulder of cylinder casing 20 in forcible manner or in the pressure-dependent manner through a corresponding overpressure in the pump chamber. The outer end of cylinder casing 20 is closed by a cylinder cover cap 27, which forms the ring flange 11 and is traversed by the piston rod 24. Between the pump chamber and suction channel 17, each discharge pump 3 has an inlet valve 26 in the form of a ball valve, which closes in the case of an overpressure in the pump chamber, i.e. during the pump stroke.

On the inside of its end wall, which also contains the outlet channels 15, handle 10 has a number of projecting plug sleeves 28 corresponding to the number of reservoirs 2 and they are connected in axially secured manner by engagement with the outer ends of the piston rods 24, in such a way that all the cylinder cover caps 27 of discharge pump 3 are covered by handle 10.

For stabilizing the position of reservoir 2 with respect to one another in their bottom region facing handle 10 is provided a mounting bridge 29 in the form of an oval flat shell, which with their pitch circular partition portions closely embrace the reservoirs 2 by engagement and with their base plate form the base for the discharge apparatus. The mounting bridge 29 forms a separate component, so that reservoirs 2 can firstly be fixed to the top cap 5 and then the mounting bridge 29 is fitted.

As is shown in FIG. 4, in the vicinity or adjacent to outlet port 16 a nozzle body 30 can be provided in the media flow path and is provided on its circumference with swirl grooves 31. Instead of or in addition to the latter spiral grooves 32 can be provided on at least one end face of the nozzle body 30. The media components to be mixed are either supplied separately or in already combined form to the nozzle body 30, where they are vigorously whirled and consequently intensely mixed and they then pass out through the outlet port 16, optionally in the form of a spray jet.

In the embodiment according to FIG. 5, a separate outlet port 16*a* is provided for each component, the two outlet ports 16*a* being provided closely adjacent to one another at the ends of projecting spouts 19*a* which slope towards one another. The outlet channels 15*a* are not interconnected within the discharge apparatus 1*a* and instead the media components only meet one another immediately after leaving the outlet ports 16*a* outside the discharge apparatus 1*a* and in the immediate vicinity of said ports 16*a*, so that they are here brought and mixed together.

It is particularly advantageous if at least one or at least two discharge pumps can be adjusted with respect to their discharge quantity, e.g. in accordance with German patent application No. P 32 25 910.7, to which reference should be made for further details. Thus, the mixing ratio of the components can be adapted at any time to the requirements.

We claim:

1. A dispenser for manually discharging media, comprising:

a mounting bridge (5) having separate mounting elements (6) for connecting at least two separate containers (2), each container defining a reservoir for a media component;

a manually operable discharge thrust pump (3) for each of said containers (2), each discharge thrust pump (3) having an inlet provided for duct connection with an associated one of said containers (2) and an outlet duct (14) for connecting said inlet to an outlet port (16); and, a common handle means (10) for at least two said discharge thrust pumps (3), said handle means (10) being provided for manually operating said discharge thrust pump (3), and wherein each mounting element (6) is constructed as a closure means (6) for an access opening of an associated one of said containers (2), each mounting element (6) being traversed by a separate pump mount for a separate thrust pump (3), said handle means providing a common pump handle (10) for at least two of said thrust pumps (3).

2. A dispenser according to claim 1, wherein at least one of said thrust pumps (3) has a pump casing adapted for mounting on the mounting element and adapted for arrangement in said access opening of said associated one of said containers.

3. A dispenser according to claim 1, wherein at least one of said separate thrust pumps (3) is a thrust piston pump having a pump chamber connected to a suction duct (17) and to the outlet duct (14).

4. A dispenser according to claim 1, wherein at least two outlet ducts (14) of at least two thrust pumps (3) lead to at least one component mixing zone.

5. A dispenser according to claim 4, wherein said component mixing zone is located in the immediate vicinity of at least one outlet port (16) provided on said pump handle.

6. A dispenser according to claim 4, wherein at least one component mixing zone is provided in said pump handle (10), upstream of at least one outlet port (16).

7. A dispenser according to claim 4, wherein at least one component mixing zone is provided directly adjacent to an inlet of an outlet nozzle of said pump handle (10).

8. A dispenser according to claim 4, wherein a nozzle body is provided in said pump handle (10), at least one component mixing zone being provided in the vicinity of the nozzle body (30).

9. A dispenser according to claim 1, wherein the nozzle body (30) is provided with swirl grooves (31) respective spiral grooves (32) on the circumference respective on at least one end face.

10. A dispenser according to claim 4, wherein at least one mixing zone is provided downstream of the outlet port (16*a* ).

11. A dispenser according to claim 4, wherein the dispenser provides an outside, at least one mixing zone being provided on the outside of the dispenser (1*a* ) in a spray zone.

12. A dispenser according to claim 1, wherein at least two outlet ducts (14) of at least two separate thrust pumps (3) pass into a common end duct (18) of said pump handle (10).

13. A dispenser according to claim 1, wherein at least two outlet ports (16*a*) of at least two separate thrust pumps (3) are provided for commonly emersing separate discharge jets.

14. A dispenser according to claim 13, wherein said outlet ports (16*a*) are oriented for overlapping discharge jets.

15. A dispenser according to claim 13, wherein all of the at least two outlet ports (16*a*) are provided on the pump handle (10*a*).

16. A dispenser according to claim 1, wherein two outlet ports (16*a*) are located at ends of freely projecting spouts (19*a*).

17. A dispenser according to claim 1, wherein said pump handle is provided for interconnecting at least two juxtaposed piston rods (24) of said thrust pumps (3).

18. A dispenser according to claim 1, wherein said pump handle (10) is provided as an interconnecting bridge member engaging said mounting bridge (5).

19. A dispenser according to claim 1, wherein said pump handle is constructed as a one piece handle (10).

20. A dispenser according to claim 1, wherein at least two discharge ducts (15) are provided for connection with the outlet ducts (14) of at least two separate thrust pumps (3), and are provided in the pump handle (10).

21. A dispenser according to claim 20, wherein said discharge ducts (15) are connected to plug sleeves (28) of the pump handle (10), said plug sleeves (28) being provided for attaching the pump handle (10) to the at least two separate thrust pumps (3).

22. A dispenser according to claim 20, wherein at least two discharge ducts (15) are directed substantially equiaxially towards one another.

23. A dispenser according to claim 20, wherein the discharge ducts (15) are located at right angles to the outlet port (16) respective the end duct (18).

24. A dispenser according to claim 1, wherein the outlet port (16) is located substantially in a central plane between the thrust pumps (3).

25. A dispenser according to claim 1, wherein the outlet port (16) is located substantially at right angles to a common axial plane of the thrust pumps (3).

26. A dispenser according to claim 1, wherein said mounting bridge is cap shaped.

27. A dispenser according to claim 1, wherein said mounting bridge (5) has a ring web (12) and said pump handle (10) has a rim jacket (13) engaging into said ring web (12) of the mounting bridge (5) and corresponding to a basic shape of the mounting bridge (5).

28. A dispenser according to claim 1, wherein said closure elements are provided for a detachable connection with said containers.

29. A dispenser according to claim 1, wherein said closure elements are mounting caps (6) for bottle necks (4) of said containers (2) located substantially parallel and directly adjacent to one another.

30. A dispenser according to claim 1, wherein said pump handle (10) is oval with long sides, said outlet port (16) being located on one of said long sides of said pump handle (10).

31. A dispenser according to claim 1, wherein said mounting bridge (5) is oval.

32. A dispenser according to claim 1, wherein an additional mounting bridge (29) is provided for at least two of said containers (2).

33. A dispenser according to claim 32, wherein said additional mounting bridge (29) faces said mounting bridge (5), said additional mounting bridge being adapted to a bottom region of the at least two containers (2).

34. A dispenser according to claim 32, wherein said additional mounting bridge (20) is formed by a flat plug cap adapted for closely embracing said containers.

35. A dispenser according to claim 1, wherein said thrust pumps (3) each have a piston sleeve (22) mounted in axially displaceable manner on a piston rod member (24) by means of a resilient compression jacket (23), said outlet duct (14) and an associated outlet valve (25) being provided in said piston rod member (24), a valve body of said outlet valve (25) being in an opened position with respect to the piston rod member (24) in a displacement positon of the piston sleeve (22).

* * * * *